United States Patent [19]

Stobbe

[11] Patent Number: 4,538,783

[45] Date of Patent: Sep. 3, 1985

[54] SUSPENSION RACK FOR BAGS AND SACKS, IN PARTICULAR REFUSE DISPOSAL BAGS FOR DOMESTIC PURPOSES

[76] Inventor: Jens M. D. Stobbe, Residence du Prieuré Route des Hautes Valettes, Tourettes sur Loup Vence 06140, France

[21] Appl. No.: 495,344

[22] PCT Filed: Aug. 23, 1982

[86] PCT No.: PCT/DK82/00078

§ 371 Date: Apr. 21, 1983

§ 102(e) Date: Apr. 21, 1983

[87] PCT Pub. No.: WO83/00679

PCT Pub. Date: Mar. 3, 1983

[30] Foreign Application Priority Data

Aug. 24, 1981 [DK] Denmark ..... 3747/81

[51] Int. Cl.[3] ..... B65D 25/14

[52] U.S. Cl. ..... 248/99; 211/87; 211/104; 248/100; 248/147

[58] Field of Search ..... 248/99, 100, 101, 147; 211/96, 99, 87, 89, 104

[56] References Cited

U.S. PATENT DOCUMENTS

| | | | |
|---|---|---|---|
| 2,815,186 | 12/1957 | Miller | 248/99 |
| 2,995,329 | 8/1961 | Talcott | 248/100 X |
| 3,653,619 | 4/1972 | Plum | 248/99 |
| 3,724,921 | 4/1973 | Lake | 248/99 X |
| 3,807,598 | 4/1974 | Nutt | 248/99 |

FOREIGN PATENT DOCUMENTS

| | | | |
|---|---|---|---|
| 193023 | 11/1964 | Sweden | 248/99 |
| 1073895 | 6/1967 | United Kingdom | 248/99 |

*Primary Examiner*—Robert W. Gibson, Jr.
*Attorney, Agent, or Firm*—Robert J. Koch

[57] ABSTRACT

In a rack particularly intended for suspending refuse disposal bags and having a circumferentially discontinuous carrier of variable size designed to retaining and stretching the top or mouth portion of the bag, said carrier comprises opposite, scissorslike holders (18,19 and 20,21) capable of distending the bag mouth both in an open position, substantially in rhomboid shape, and in a closed, assembled or collapsed position, thereby saving a cover for covering the bag between the fillings.

The holders are preferably mounted in a pair of brackets (2,3) having an adjustable spacing so that the rack may be used for bags and sacks of considerably varying mouth sizes.

6 Claims, 2 Drawing Figures

FIG. 1
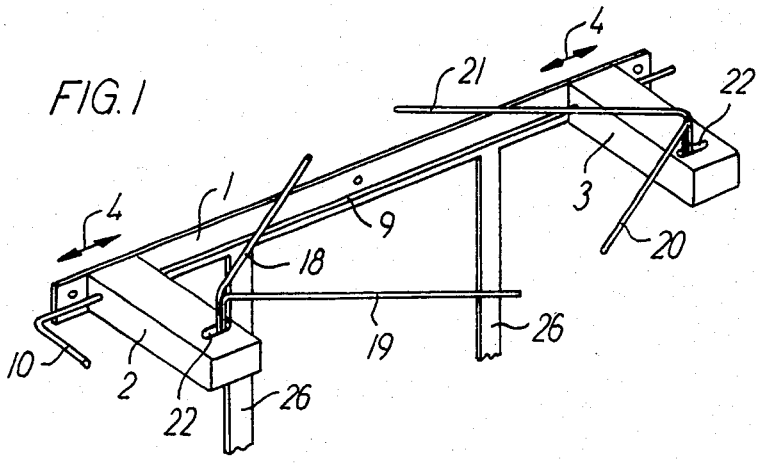
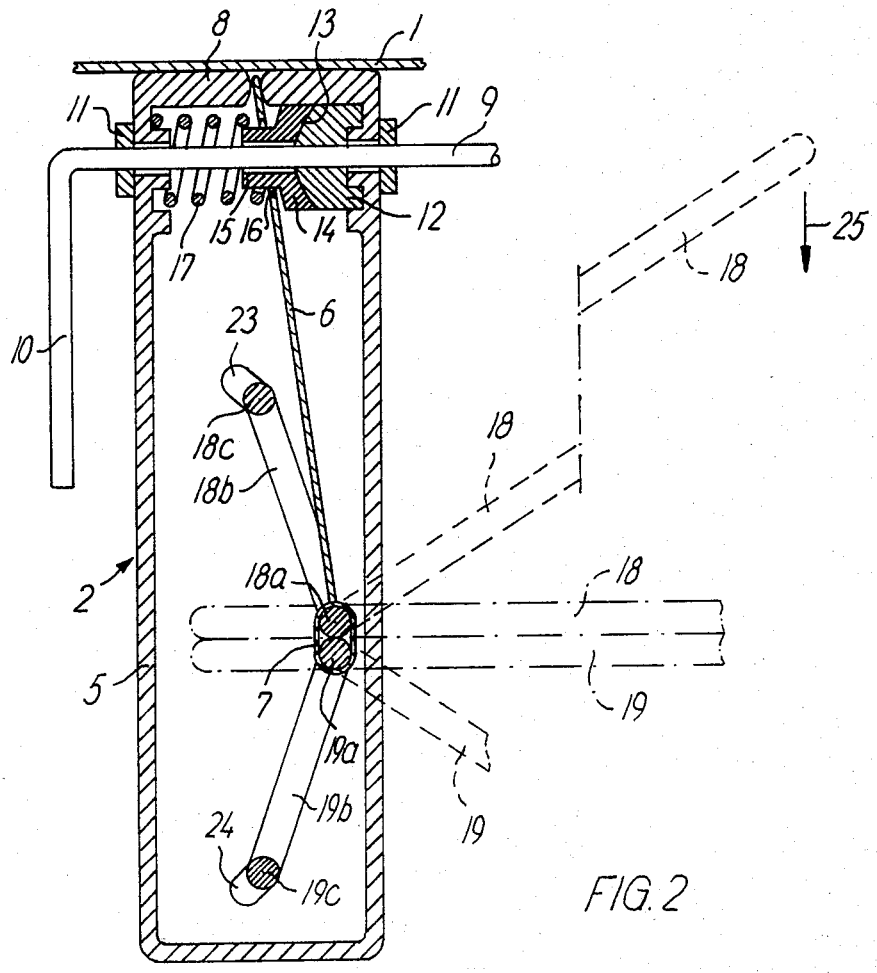
FIG. 2

SUSPENSION RACK FOR BAGS AND SACKS, IN PARTICULAR REFUSE DISPOSAL BAGS FOR DOMESTIC PURPOSES

This invention relates to a suspension rack for bags and sacks, in particular refuse disposal bags for domestic purposes, comprising a circumferentially discontinuous carrier which is substantially horizontal in the position of use and is adapted to engage an everted or folded portion of the bag at its open end and to secure the bag by stretching or distending said portion.

The most widespread racks of this type are made from plastic coated wire forming both said carrier and a support for the bag bottom and, moreover, a pair of braces connecting said carrier and said support, the braces comprising eyes to be used when fastening the rack, for instance on a kitchen cupboard door. The carrier forms a substantially rectangular frame with a gap in the fowards facing side so as to present a pair of somewhat yielding wings distending the bag opening approximately into the same rectangular shape.

Filling the bag with kitchen refuse is generally done at some or many times and it may therefore be desired that the bag is kept closed between the individual fillings. For this purpose a flap cover is applicable which may be mounted on the suspension rack or possibly directly on the kitchen cupboard door. However, such a cover cannot be expected to shut tightly odourless on the suspended bag and requires, moreover, an extra manipulation when disposing a portion of refuse.

To eliminate such drawbacks a more complicated suspension rack has been developed which instead of a yielding carrying frame is provided with a pair of jaws with pins to engage perforations in the bag sides. Said jaws may be moved towards and away from each other—either manually or automatically by closing and opening the cupboard door on which the rack is mounted—and are thus able to keep the bag closed between the fillings by squeezing its mouth together. From consumer's point of view this rack suffers, however, from the inconvenience that it requires special bags that are not alone of a given size (the same applies to the first mentioned rack), but which must further be provided with perforations at the mouth in order to be hooked on the jaws.

The present invention provides a suspension rack that is not only adapted to efficiently keep the suspended bag or sack closed between the fillings by squeezing its mouth portion together, i.e. without the use of an extra cover, but which may as well be used for bags or sacks of varying size and without particular suspension measures, such as perforations in the bag wall.

This has been achieved in that the said carrier comprises two opposed, scissorslike holders, the limbs of which are movable between an open, V-like position in which they distend the mouth of the bag into rhomboid shape, and an assembled position in which the mouth or top portion of the bag while still being stretched is kept closed by collapsing.

In this case the fastening of the bag or sack is—as for the first mentioned rack—effected by distending or stretching its top portion which is a condition if said special suspension measures of the bag shall be avoided, but while maintaining the stretching effect the said holders can further open and close the bag, thereby saving an extra cover.

To ensure an efficient fastening of the bag or sack it is according to the invention preferred that the two holders are displaceable towards and away from each other and spring-biased in the last mentioned direction to ensure the stretching of the top portion of the bag.

The fact that the carrier is constituted by two holders entails the particular advantage that one and the same rack may be used for bags or sacks within a great variety of sizes, namely by providing the two holders in a respective one of two brackets mounted on a common base, said brackets being spaded adjustably apart. If the rack is associated with a support for the bottom of the bag or the sack, such support should also be adjustable according to the size of the bag, in particular to its height.

Further details of the suspension rack according to the invention will appear from the following description of a preferred embodiment with reference to the accompanying drawing, in which FIG. 1 illustrates the embodiment in a perspective view, and FIG. 2 the left part of the rack in FIG. 1, seen from above and substantially in section.

The illustrated rack is designed so that bags for kitchen refuse can be suspended thereon and it comprises a mounting plate 1 to be fastened with screws on a vertical surface, for instance on the inside of a cupboard door. The plate carries two brackets 2 and 3, at least one of which being preferably adjustable along the plate as indicated by the double-arrows 4 so as to adjust the distance between the said two brackets according to the size of the bag to be suspended. The two brackets may be alike as to structure, but symmetrically designed, and their details appear from FIG. 2.

It will be seen that the bracket comprises a box-shaped housing 5 accommodating a supporting arm or lever 6, appropriately made from spring steel, provided with a bushing 7 at its one end while its other end engages a slit in the rear wall 8 of the housing, said rear wall being secured to the mounting plate 1 in a manner not shown. From the position illustrated in FIG. 2 the arm or lever 6 can be pivoted somewhat to the left by rotating a spindle 9 by a handle 10. Said spindle 9 is accommodated in the side walls of the housing 5 and retained against axial displacement by means of a pair of stop rings 11. Within the housing the spindle carries a cam 12 which is fixed to the spindle so as to rotate therewith and presents a cylindrically arched abutting surface 13 for a loose cam 14 provided with a projection 15 having a non-circular cross-section and extending through an oblong hole 16 in the supporting arm or lever 6, thereby preventing the loose cam from rotating about the axis of the spindle 9. A pressure spring 17 urges the lever rod against the loose cam 14, which is thereby at the same time urged against the cam 12. A rotational movement of the spindle 9 and thus also of the cam 12 consequently results in a displacement to the left of the cam 14 bringing along the lever 6 by pivoting it about the bearing point at the rear wall 8 of the housing. The lever may simultaneously be displaced a little at the bearing point so as to allow the bushing 7 of the lever when swinging to follow a straight line instead of a circular arc. The abutting surface 13 between said two cams 12 and 14 need of course not be cylindrically arched as it may as well be roof-shaped or plane and form an angle different from 90° with the axis of the spindle 9.

Either of the brackets 2 and 3 accommodates a holder consisting of two pieces of bar material forming altogether a pair of tongs or scissors with two limbs 18 and 19, 20 and 21, respectively. The two associate limbs are integral with a respective one of two vertical bar sections 18*a*, 19*a* which extend downwardly through a guide slit 22, FIG. 1, in the upper wall of bracket housing 5 and are journalled in laterally abutting relationship in the aforementioned bushing 7, beneath which said sections continue into control levers 18*b* and 19*b* pointing towards the ends of the bracket housing 5 and resting on its bottom. With their angularly bent ends 18*c* and 19*c* the control levers 18*b* and 19*b* engage inclined guide slots 23 and 24 at the bottom of the housing so that the control levers convert the displacement of the bushing 7, referred to above, into a rotation of the bar pieces, thereby swinging the limbs 18 and 19, 20 and 21, respectively, from the open position as shown in FIG. 1, towards each other to the assembled or collapsed position shown in dotted lines in FIG. 2.

The holders 18, 19 and 20,21 of the rack being in the V-like position shown in FIG. 1, a bag can be suspended in the same way as is the case with ordinary racks with a frame-shaped carrier, the top edge of the bag being everted or folded over the limbs 18–21, following which the top of the bag is kept stretched and distended approximately in rhomboid shape. After a portion of refuse has been filled into the bag, the handle 10 and thus also the spindle 9 common to the two brackets 2 and 3, are rotated through an angle of less than 90°, so that the two scissors- or tonglike holders 18,19 and 20,21 are folded up and displaced as explained above, thereby closing the mouth of the bag. The edge portion of the bag shall then remain in a stretched position which according to the illustrated embodiment is ensured by moving the ends of the four limbs 18–21 pependicularly to the connecting line between the vertices of the two holders, as indicated by the arrow 25 in FIG. 2. This implies that the length of the guide slits 22 in the bracket housings at least corresponds to the longitudinal difference between a holder limb and its projection on said connecting line.

The said rotation of the spindle 9 may be effected manually, but in case the rack is mounted on a cupboard door the rotation may as well be effected automatically when opening and closing the door, the handle 10 being then adapted to engage and disengage an operating member designed and mounted in an appropriate manner. Particularly when an isolated or detached rack for bigger bags or sacks is concerned, the handle may be connected with a pedal.

FIG. 1 illustrates parts of a pair of vertical rack braces 26 supporting a support, not shown, for the bag bottom. As mentioned above such a bottom support may as well be adjustable according to the size of the bag.

I claim:

1. A suspension rack for bags and sacks, comprising:

a base member secured to a support structure, a pair of brackets projecting from said base member, and a discontinuous frame-like collapsible bag carrier mounted on said brackets and adapted to engage and circumferentially stretch an everted portion of a bag at the open end thereof, said bag carrier including a pair of holders, each said holder mounted in a respective bracket, and formed by a pair of frame limbs which are movable between a closed parallel position and an open V-like position, the vertices of the holders pointing away from each other, at least one of said holders being displaceable in its bracket substantially parallel to said base member and being resiliently biased in a direction away from the other holder to permanently keep said everted bag portion circumferentially stretched.

2. A suspension rack as claimed in claim 1, wherein the spacing of said brackets on said base member is adjustable.

3. A suspension rack as claimed in claim 1, wherein the frame limbs of each holder are integral with the upper ends of respective substantially vertical bar sections journalled in a common bushing mounted for lateral displacement in the associated bracket, said bar sections at their lower ends being integral with respective control levers extending substantially horizontally and transversely to the direction of displacement of said bushing, the other end of each of said control levers being pivotally engaged in a guide slot in said bracket so as to coordinate a displacement of said bushing with a swinging of the frame limbs between their open and closed positions.

4. A suspension rack as claimed in claim 3, wherein said bushing is carried by one end of a substantially horizontal arm which at its other end has a fulcrum in the bracket and between its ends is engaged by a mechanism operable to swing the arm about said fulcrum.

5. A suspension rack as claimed in claim 4, wherein said arm is adapted to resiliently bias said bushing in a direction away from the other holder of the rack.

6. A suspension rack as claimed in claim 4, wherein said mechanism comprises a spindle journalled in both of the brackets for reciprocal rotation through an angle of approximately 90° and provided with at least one arm-engaging cam.

* * * * *